US006789557B1

(12) United States Patent
Wahl, Jr.

(10) Patent No.: US 6,789,557 B1
(45) Date of Patent: Sep. 14, 2004

(54) PORTABLE AND COLLAPSIBLE SUNSHADE APPARATUS FOR PROVIDING SHADE TO A USER HAVING A UNIVERSAL CLIP TO ATTACH THE SUNSHADE TO ANY TYPE OF BEACH CHAIR OR LOUNGE CHAIR

(76) Inventor: Gene Wahl, Jr., 4119 Calle Mayo, San Clemente, CA (US) 92673

( * ) Notice: Subject to any disclaimer, the term of this patent is extended or adjusted under 35 U.S.C. 154(b) by 0 days.

(21) Appl. No.: 10/419,019

(22) Filed: Apr. 18, 2003

Related U.S. Application Data

(63) Continuation-in-part of application No. 09/892,182, filed on Jun. 25, 2001, now abandoned.

(51) Int. Cl.[7] ..... E09H 15/48

(52) U.S. Cl. ..... 135/154; 135/16; 135/90; 135/96; 135/117; 135/119; 135/120.2; 135/120.3; 135/143; 248/231.8; 248/316.5; 248/316.6; 248/316.7; 248/534; 248/535; 248/536; 297/184.11; 297/184.15; 297/188.05; 297/188.06

(58) Field of Search ..... 135/16, 90, 96, 135/87, 98, 88.01, 88.1, 88.15, 120.1, 120.2, 120.3, 143, 154, 156, 115, 117, 119; 248/230, 231.8, 534–536, 541, 316.1, 316.5–316.7; 297/184.1, 184.11, 184.15, 188.04–188.06

(56) References Cited

U.S. PATENT DOCUMENTS

| | | | | | |
|---|---|---|---|---|---|
| 405,038 | A | | 6/1889 | Koechling | |
| 840,241 | A | * | 1/1907 | Nootbaar | 248/515 |
| 923,596 | A | * | 6/1909 | Staples | 248/514 |
| 1,480,286 | A | | 1/1924 | Morganstern | |
| 2,660,186 | A | | 11/1953 | Marshall et al. | |
| 3,289,982 | A | * | 12/1966 | Hart, Jr. | 248/541 |
| 3,434,483 | A | * | 3/1969 | Topham | 135/151 |
| 3,533,590 | A | * | 10/1970 | Swire | 248/311.2 |
| 3,904,161 | A | * | 9/1975 | Scott | 248/541 |
| 4,063,318 | A | | 12/1977 | Nicholson | |
| 4,295,481 | A | | 10/1981 | Gee | |
| D265,862 | S | | 8/1982 | Caldwell | |
| 4,375,901 | A | | 3/1983 | MacDonald | |
| 4,736,921 | A | * | 4/1988 | Zane et al. | 248/316.2 |
| 4,809,724 | A | * | 3/1989 | Fuser | 135/16 |
| 4,865,381 | A | * | 9/1989 | Van Rogue | 297/184.15 |
| 5,000,210 | A | * | 3/1991 | Worthington, Jr. | 135/90 |
| 5,022,420 | A | * | 6/1991 | Brim | 135/88.01 |
| 5,096,257 | A | | 3/1992 | Clark | |
| 5,168,889 | A | * | 12/1992 | Diestel | 135/88.01 |
| 5,203,363 | A | | 4/1993 | Kidwell et al. | |
| 5,240,020 | A | * | 8/1993 | Byers | 135/96 |
| 5,344,115 | A | * | 9/1994 | Mayne et al. | 248/514 |
| 5,622,345 | A | * | 4/1997 | Hopkins | 248/230.5 |
| 5,797,650 | A | * | 8/1998 | Gonzalez, Jr. et al. | 297/184.1 |
| 5,836,327 | A | * | 11/1998 | Davis | 135/16 |
| 5,918,613 | A | * | 7/1999 | Larson | 135/88.01 |
| 5,967,601 | A | | 10/1999 | Gillins | |
| 6,349,666 | B1 | * | 2/2002 | Hastings | 114/361 |
| 6,371,553 | B1 | * | 4/2002 | Tang | 297/184.1 |
| 6,375,146 | B1 | * | 4/2002 | Painchaud | 248/534 |
| 6,588,966 | B2 | * | 7/2003 | Kane et al. | 403/61 |
| 2002/0125388 | A1 | * | 9/2002 | Eslick | 248/230.4 |

* cited by examiner

*Primary Examiner*—Carl D. Friedman
*Assistant Examiner*—Yvonne M. Horton
(74) *Attorney, Agent, or Firm*—Thomas I. Rozsa; Tony D. Chen

(57) ABSTRACT

A portable and collapsible sunshade apparatus which can be conveniently folded up and carried in a bag so that the sunshade apparatus can be easily transported to the beach or other locations for attachment to a beach chair or lounge chair through use of a novel attachment clip. The universal clip enables any type of sunshade apparatus to be attached to any type of beach chair or lounge chair at any desired height above the occupant of the chair and at any desired angular orientation relative to the chair.

26 Claims, 9 Drawing Sheets

PORTABLE AND COLLAPSIBLE SUNSHADE APPARATUS FOR PROVIDING SHADE TO A USER HAVING A UNIVERSAL CLIP TO ATTACH THE SUNSHADE TO ANY TYPE OF BEACH CHAIR OR LOUNGE CHAIR

This is a continuation-in-part of patent application Ser. No. 09/892,182 filed Jun. 25, 2001, now ABN.

BACKGROUND OF THE INVENTION

1. Field of the Invention

The present invention relates generally to the field of shades. More particularly, the present invention relates to portable sunshade apparatus which can be used by itself or removably attachable to a variety of different sizes and styles of recreational chairs or the like through use of a novel attachment mechanism.

2. Description of the Prior Art

Over the years, various sunshade devices have been developed for providing shade to sunbathers or the like. Conventional umbrella-type devices are still widely used by beachgoers, homeowners, and commercial establishments such as restaurants, hotels and resorts, as a means to provide shade to the user against the sun's rays. One problem with umbrella-type devices is that they are bulky and inconvenient for transporting them to the beach or other locations which require shade from the sun's rays. Another problem with these umbrella-type devices is that they are difficult to adjust as the sun changes locations in the sky during the course of the day. Another prior art shade is a ground supported shade having an adjustable canopy but has proven to be inflexible since the user may during one portion of the day, desire to lie upon the beach sand, while during another portion of the day prefer to sit in a beach chair. The prior art ground supported canopy is not adaptable to use on a beach chair.

The following twelve (12) prior art patents are found to be pertinent to the field of the present invention:

1. U.S. Pat. No. 405,038 issued to Koechling on Jun. 11, 1889 for "Beach Chair" (hereafter the "Koechling Patent");

2. U.S. Pat. No. 1,480,286 issued to Morganstern on Jan. 8, 1924 for "Sand Or Outing Rest Or The Like" (hereafter the "Morganstern Patent");

3. U.S. Pat. No. 2,660,186 issued to Marshall et al. on Nov. 24, 1953 for "Shade-Producing Apparatus" (hereafter the "Marshall Patent");

4. U.S. Pat. No. 3,434,483 issued to Topham on Mar. 25, 1969 for "Portable Windbreaker" (hereafter the "Topham Patent");

5. U.S. Pat. No. 4,063,318 issued to Nicholson on Dec. 20, 1977 for "Folding Frame Assembly" (hereafter the "Nicholson Patent");

6. U.S. Pat. No. 4,295,481 issued to Gee on Oct. 20, 1981 for "Convertible Sun Shade" (hereafter the "Gee Patent");

7. U.S. Pat. No. 265,862 issued to Caldwell on Aug. 24, 1982 for "Pole-Mounted Sun Shade" (hereafter the "Caldwell Patent");

8. U.S. Pat. No. 4,375,901 issued to MacDonald on Mar. 8, 1983 for "Beach Chair" (hereafter the "MacDonald Patent");

9. U.S. Pat. No. 5,096,257 issued to Clark on Mar. 17, 1992 for "Sunshade Apparatus For Chair" (hereafter the "Clark Patent");

10. U.S. Pat. No. 5,203,363 issued to Kidwell et al. on Apr. 20, 1993 for "Portable Canopy Attachment" (hereafter the "Kidwell Patent");

11. U.S. Pat. No. 5,967,601 issued to Gillins on Oct. 19, 1999 for "Sunshade Apparatus For Recreational Chair" (hereafter the "Gillins Patent"); and 12. PCT No. WO 99/18825 for "Sunshade For A Chair And A Chair Incorporating Same" (hereafter "the '825 PCT").

The Koechling Patent discloses a beach chair for providing a backrest to a user.

The Morganstern Patent discloses a sand or outing rest or the like. It is a seating device which includes a rigid seat and back rest.

The Marshall Patent discloses a shade-producing apparatus. The apparatus utilizes a plurality of shorter poles which are connected by links to form an elongated pole.

The Topham Patent discloses a portable windbreaker. It comprises a frame with a cross rod and supporting legs. The cross rod is hinged at its center and the legs pivotable relative to each other and to the cross rod to fold the windbreaker up.

The Nicholson Patent discloses a folding frame assembly for providing support to a user's head.

The Gee Patent discloses a convertible sunshade which is convertible from a ground supported shade to a chair-back supported shade. The sunshade comprises a U-shaped support member with the bottom portion of the U-shaped support as a rearward support for the shade and the legs of U-shaped support being forwardly positioned.

The MacDonald Patent discloses a beach chair.

The Clark Patent discloses a sunshade apparatus for a chair. It comprises a canopy structure for supporting a fabric cover and adjustably attached to two parallel shade support arms. A pair of clamps hold the shade support arms to the back of the chair.

The Kidwell Patent discloses a portable canopy attachment.

The Gillins Patent discloses a sunshade apparatus for a recreational chair. It comprises a rigid support to which upper edge clips and side edge clips are connected for releasable attachment to the seat back upper edge and seat back side edge. The upper edge clips have a hook portion to enable the sunshade to hang on the seat back upper edge. The canopy frame can be pivoted to a collapsed flat position.

The Caldwell Patent discloses a pole-mounted sunshade. This is a design patent and only protects the shape of the device, not how it operates.

The '825 PCT discloses a sunshade which is attached to a chair.

It is desirable to provide a portable sunshade apparatus which can be used on the beach sand by itself or adaptable to a beach chair for providing shade against the sun's rays.

It is also desirable to have a unique attachment mechanism which permits the portable sunshade apparatus to be attached to any type of beach chair or lounge chair.

SUMMARY OF THE INVENTION

The present invention is a portable and collapsible sunshade apparatus which is specially adapted to conveniently provide several useful features desired by anyone going to a beach or the like. The purpose of the portable sunshade apparatus is used for blocking the sun's rays to a user. In addition, the portable sunshade device can be removably attached to outdoor furniture, such as a lounge chair or beach chair by a removable clamping mechanism. Furthermore, the portable sunshade apparatus is rigid enough to be used as a back and head support.

The portable sunshade apparatus can be used by itself and is free-standing. The sunshade apparatus comprises a frame which has a top sunshade portion and a back sunshade portion. The top sunshade portion is hingeably connected to the back sunshade portion and is collapsible inwardly against the back sunshade portion for providing portability to the sunshade apparatus. Two telescopic legs are provided with the back sunshade portion and can be adjusted vertically in an up or down motion to provide a height needed by different users. The bottom ends of the telescopic legs are forced into the beach sand so that the sunshade device can be free standing for blocking the sun's rays to a user.

The portable sunshade apparatus can be used as a head and back support device, where the telescopic legs are forced into the beach sand at an angle. The top and bottom sunshade portions form an "A" cross-section configuration, thereby providing the head and back support device for the user.

The portable sunshade apparatus can be used in conjunction with a lounge chair or the like. There are provided clip-on members which can be snapped or attached onto the lounge chair, where the telescopic legs are inserted into the clip-on members for providing shade to a user sitting in the lounge chair.

An improvement in the present invention is to provide a novel attachment means in the form of a universal clip which will enable any type of sunshade apparatus to be attached to any type of beach chair or lounge chair at any desired height above the occupant of the chair and at any desired angular orientation relative to the chair.

A further improvement in the present invention is to provide a collapsible sunshade apparatus which can be conveniently folded up and carried in a bag so that the sunshade apparatus can be easily transported to the beach or other location for attachment to a beach chair or lounge chair through use of the novel attachment means of the present invention.

It is an object of the present invention to provide a portable sunshade apparatus for a lounge chair or the like, that will protect a person from the hot summer sun outdoors at the pool, yard, picnic area, beach and the like.

It is also an object of the present invention to a portable sunshade apparatus which is convertible from a ground supported shade to a chair-back supported shade.

It is an additional object of the present invention to provide a portable sunshade apparatus which is easily locked into a variety of positions so as to enable it to follow the sun during the course of the day to block the sun's rays.

It is a further object of the present invention to provide a portable sunshade apparatus that is simple and easy to use.

It is still a further object of the present invention to provide a portable sunshade apparatus that is economical in cost to manufacture.

It is another object of the present invention to provide a novel attachment means that has a multiplicity of attachment sites to be locked onto the side of a chair to accommodate any type of beach chair or lounge chair.

It is an additional object of the present invention to provide a novel attachment means which includes a rotatable ratchet mechanism so that the attachment portion which supports the legs of a sunshade apparatus can be rotated to any desired orientation relative to the chair so that the sunshade can be locked into a variety of positions so that the shade awning can be adjusted to provide shade from the sun as the angle of the sun's rays change during the day.

It is a further object of the present invention to provide a novel locking mechanism by which the vertical tubing legs of the sunshade apparatus can be secured at any desired location on the clip attachment means so that the height of the sunshade awning above the chair's occupant can be adjusted to any desired height.

It is another object of the present invention to provide a collapsible sunshade apparatus which can be oriented to a fixed position so that it can be attached to a chair through the novel attachment means and have its awning spread above the chair to provide shade, and when not in use, can be conveniently folded up and carried in a bag so that the sunshade apparatus can be easily transported to the beach or other location for subsequent attachment to a beach chair or lounge chair through use of the novel attachment means of the present invention.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
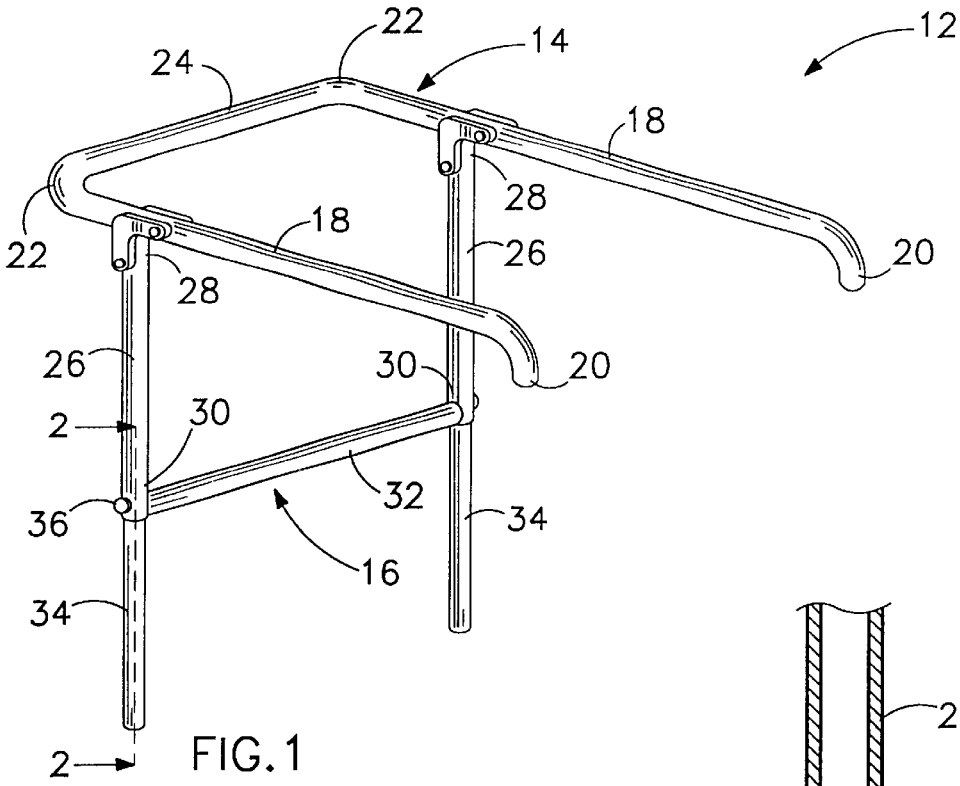
FIG. 1 is a perspective view of the support member in accordance with the present invention portable sunshade apparatus.
Figure 2:
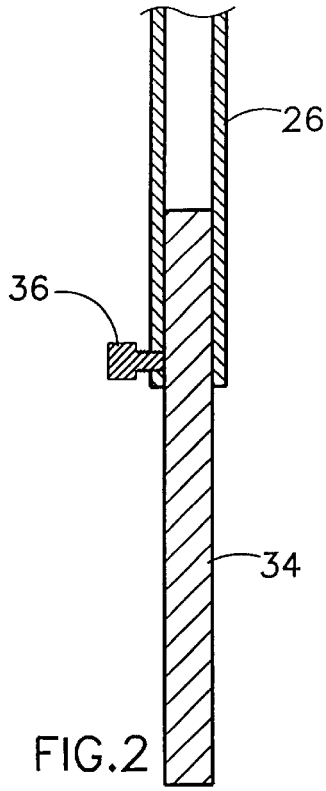
FIG. 2 is an enlarged cross-sectional view taken along line 2—2 of FIG. 1.
Figure 6:
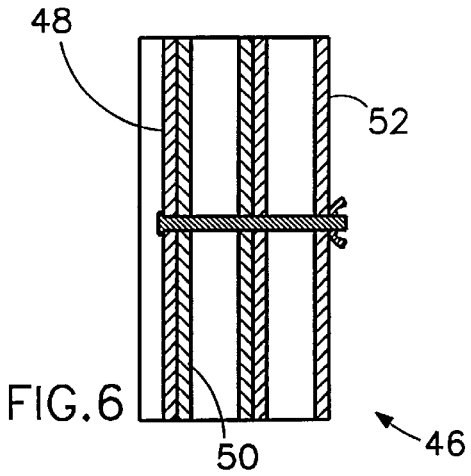
FIG. 6 is a cross-sectional view taken along line 6—6 of FIG. 5.
Figure 3:
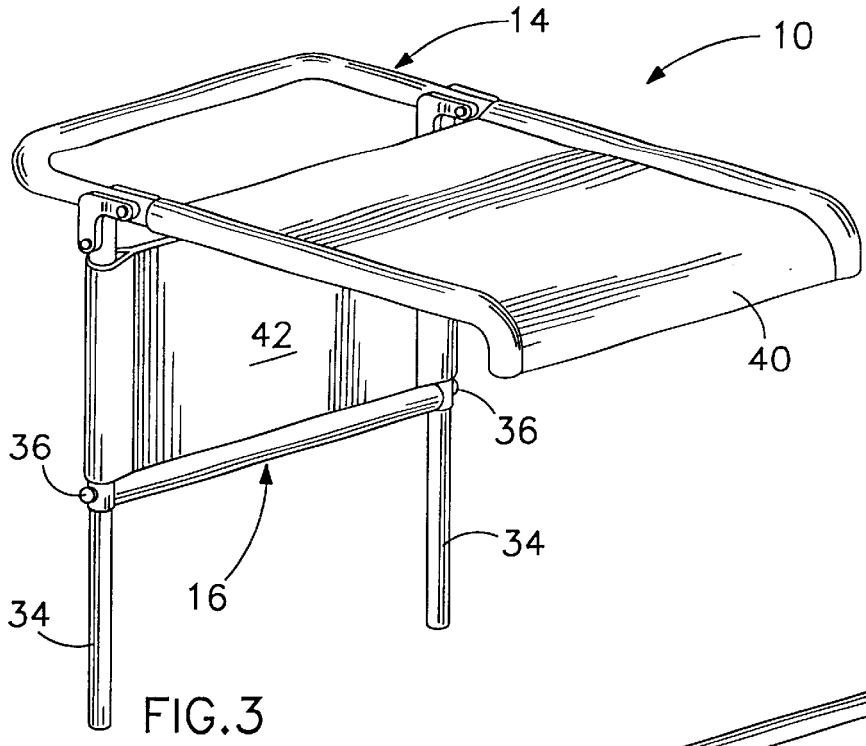
FIG. 3 is a perspective view of the present invention portable sunshade apparatus in its ground support condition.

Referring to FIG. 1, there is shown at 12 a support member of the present invention portable sunshade apparatus 10 which is shown with all of its components in FIG. 3. The support member 12 comprises a U-shaped upper frame 14 and a U-shaped lower frame 16. The upper frame 14 has a pair of parallel legs 18 which are spaced apart by a cross-bar 24. Each leg has a curved distal end 20 which extends downwardly and a proximal end 22 which is integrally connected to the cross-bar 24. The lower frame 16 has a pair of parallel upper hollow legs 26 which are spaced apart by a cross-bar 32. Each upper hollow leg 26 has a proximal end 28 which is hingeably connected to a respective one of the pair of parallel legs 18 of the upper frame 14 and a distal end 30 which is integrally connected to the cross-bar 32.

Referring to FIGS. 1, 2, 3 and 4, there are provided a pair of elongated lower extendable and retractable insert legs 34 or telescopic legs which are inserted into the distal ends 30 of the upper hollow legs 26 of the lower frame 16. These lower insert legs 34 can be adjusted by loosening threaded knobs 36 which are threadedly engaged with the sides of the upper hollow legs 26 for adjusting the height of the support member 12. When the lower insert legs 34 are adjusted to the desired vertical position, the lower ends of the lower insert legs 34 are then inserted into the beach sand such that the support member 12 stands in a generally vertical position (see FIG. 7).

Figure 4:
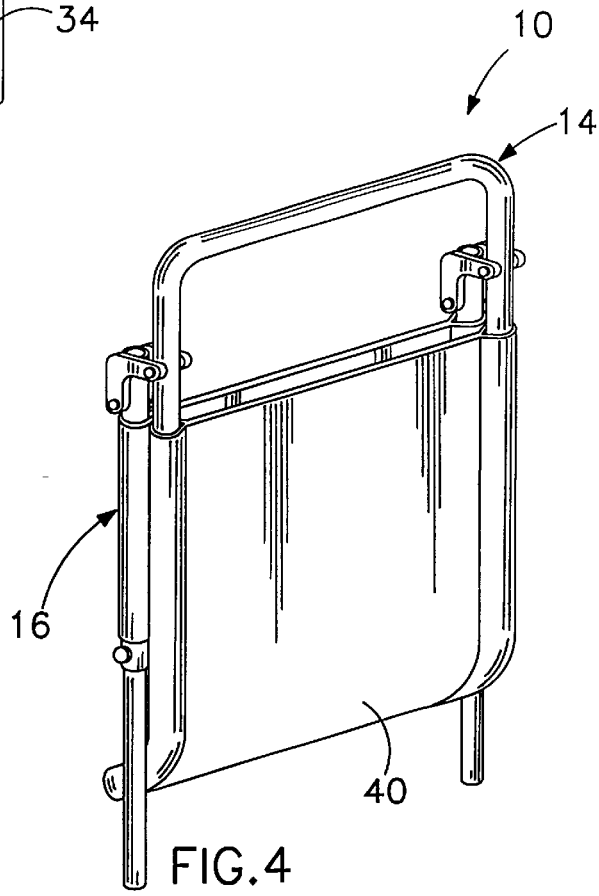
FIG. 4 is a perspective view of the present invention portable sunshade apparatus in its folded or stored condition.
Figure 7:
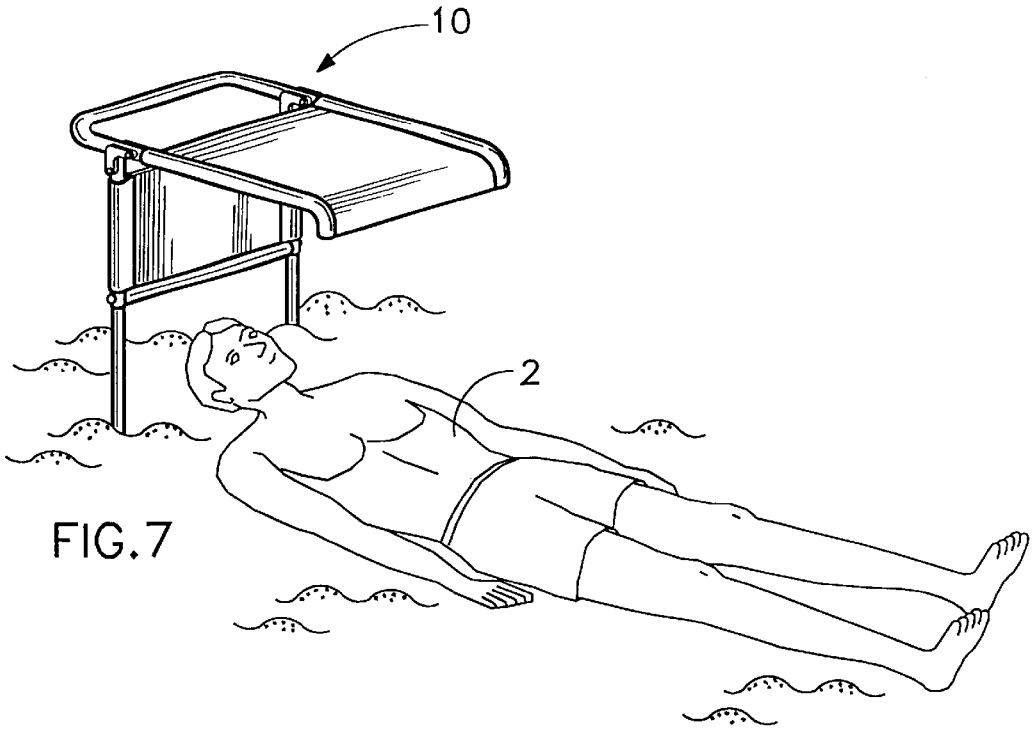
FIG. 7 is an illustration of the present invention portable sunshade apparatus positioned in the beach sand.

Referring to FIGS. 3 and 4, there is provided an upper semi-flexible canopy member 40 which is sized to fit the width of the upper frame 14 of the support member 12 which is attached thereto by conventional means, so that the canopy member 40 can extend outwardly from the support member 12 in a generally horizontal position to cover and protect a person 2 lying on the ground below the canopy member 40, such as from the sun's rays (see FIG. 7). There is also provided a lower semi-flexible canopy member 42 which is sized to fit the width of the lower frame 16 of the support member 12 which is attached thereto by conventional means and is in a generally vertical position.

Referring to FIG. 4, the support member 12 of the portable sunshade apparatus 10 can be folded when not in use for storage, by pushing the upper and lower frames 14 and 16 inwardly toward each other such that the two canopy members 40 and 42 abut each other.

Figure 8:
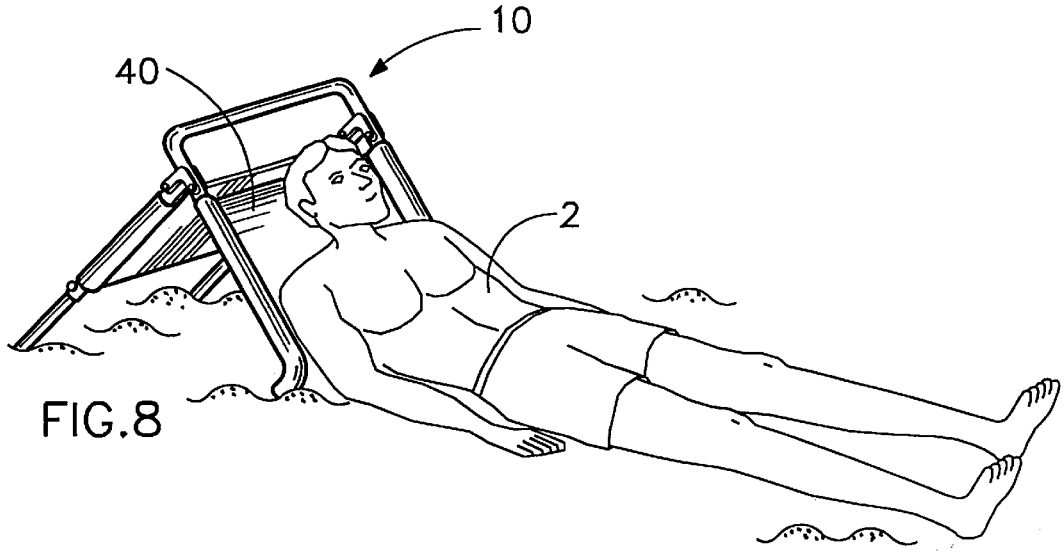
FIG. 8 is an illustration of the present invention portable sunshade apparatus in a head and back support position.

Referring to FIG. 8, there is shown the present invention portable sunshade apparatus 10 which can be used as a head support. The portable sunshade apparatus 10 is positioned at an angle, similar to an "A-shape" in the cross-section view. The lower ends of the lower insert legs 34 are positioned into the beach sand while the distal ends of the upper frame 14 are also positioned on the beach sand, thereby allowing the user's head to be supported by the canopy member 40 as shown.

Figure 5:
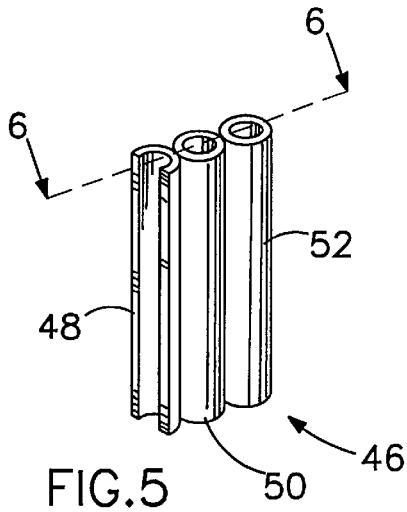
FIG. 5 is an enlarged perspective view of one of the attachment members in accordance with the present invention portable sunshade apparatus.
Figure 9:
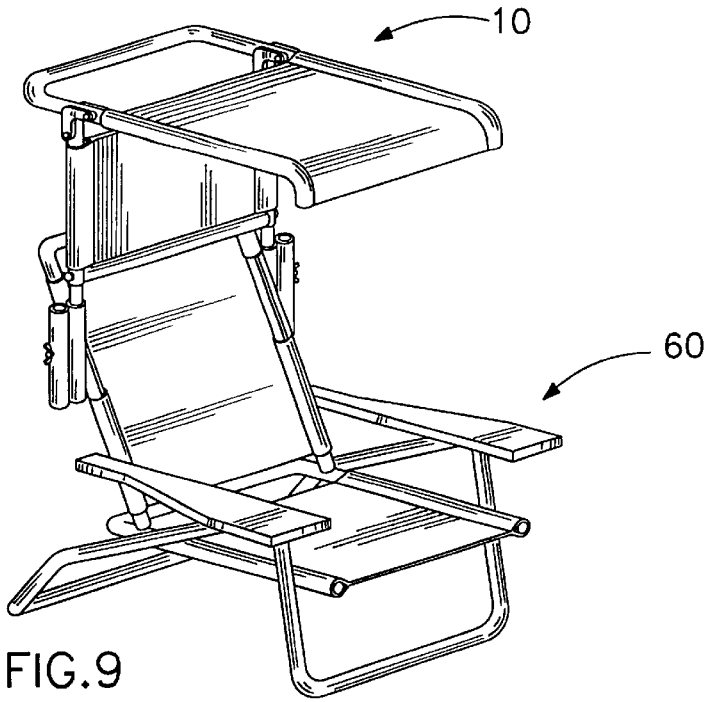
FIG. 9 is an illustration of the present invention portable sunshade apparatus removably attached to a chair.

Referring to FIGS. 5 and 9, there is shown one of the pair of removable attachable mechanisms 46 for securing it to the side of a typical outdoor beach chair or the like (see FIG. 9). The removable attachable mechanism 46 comprises a C-shaped snapping tube 48, an inner hollow holding tube 50 and an outer hollow holding tube 52. The inner and outer hollow holding tubes 50 and 52 are permanently affixed to each other in the longitudinal direction so that they will not move or rotate on their axis. The C-shaped snapping tube 48 is rotatably connected to the inner hollow tube 50 such that it can rotate 360° on its axis. Each removable attachable mechanism 46 is for removably attaching to a side of a beach chair 60 or the like, so that the support member 12 can be held about the chair 60 for providing shade to the user sitting on the chair. The lower insert legs 34 are respectively inserted either to the inner or outer hollow holding tubes 50 and 52. In this illustration, the lower insert legs 34 are inserted into the inner hollow holding tubes 50 as shown in FIG. 9. However, if the beach chair 60 was smaller in size, then the lower insert legs 34 would be inserted into the outer hollow holding tubes 52.

It will be appreciated that the removable attachable mechanism 46 can be attached to any device that has side tubular members for the C-shaped snapping tube 48, so that the portable sunshade apparatus can be used with other sitting devices not shown.

Figure 10:
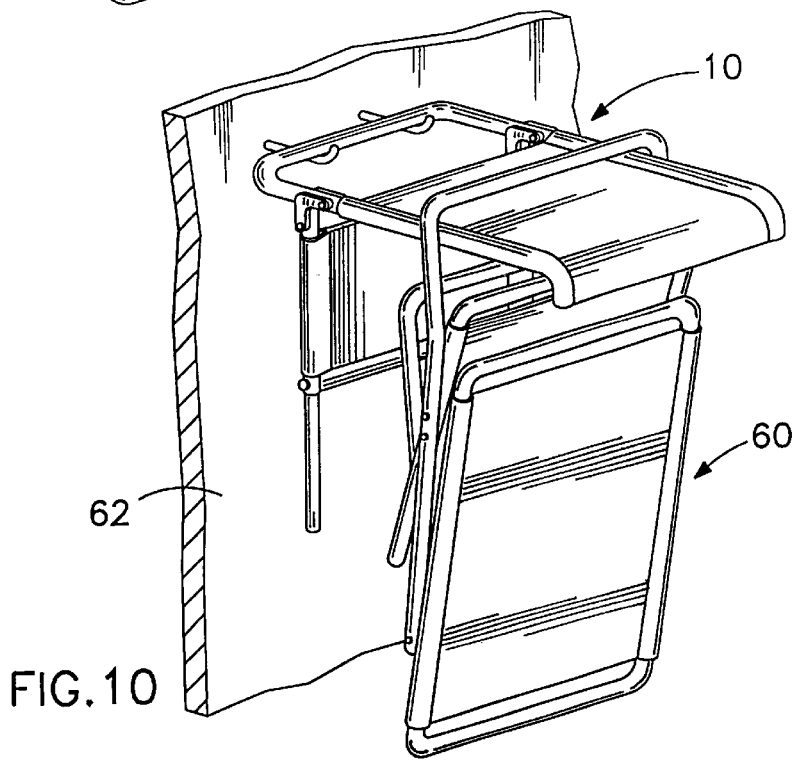
FIG. 10 is an illustration of the present invention portable sunshade apparatus used as a storing mechanism.

Referring to FIG. 10, the portable sunshade apparatus 10 can be used as a storage hook. The portable sunshade apparatus 10 is in its unfolded condition and is suspended from the wall 62 for receiving and retaining the beach chair 60 as shown.

The present invention conforms to conventional forms of manufacture or any other conventional way known to one skilled in the art, and is of simple construction and is easy to use.

Referring to FIGS. 12 through 15, there is illustrated the novel attachment means 110 of the present invention. The novel attachment means has at its front end an openable clamshell bracket member 120 having a multiplicity of parallel arcuate members. In the illustrated embodiment, two sets of parallel arcuate members are illustrated. There is an outer parallel arcuate member 122 having a first elongated arcuate wall 124 and a parallel and mating second and elongated arcuate wall 126. Adjacent and interiorly located relative to the outer parallel arcuate member 122 is an inner arcuate member 128 having a first elongated arcuate wall 130 and a parallel and mating second elongated arcuate wall 132.

The openable clam shall bracket member 120 has two halves, a first half 140 having first outer elongated arcuate wall 124 and first inner elongated arcuate wall 130 and an internal wall 142, and a second half 144 having second outer elongated arcuate wall 126 and second inner elongated arcuate wall 132 and an internal wall 146.

Figure 11:
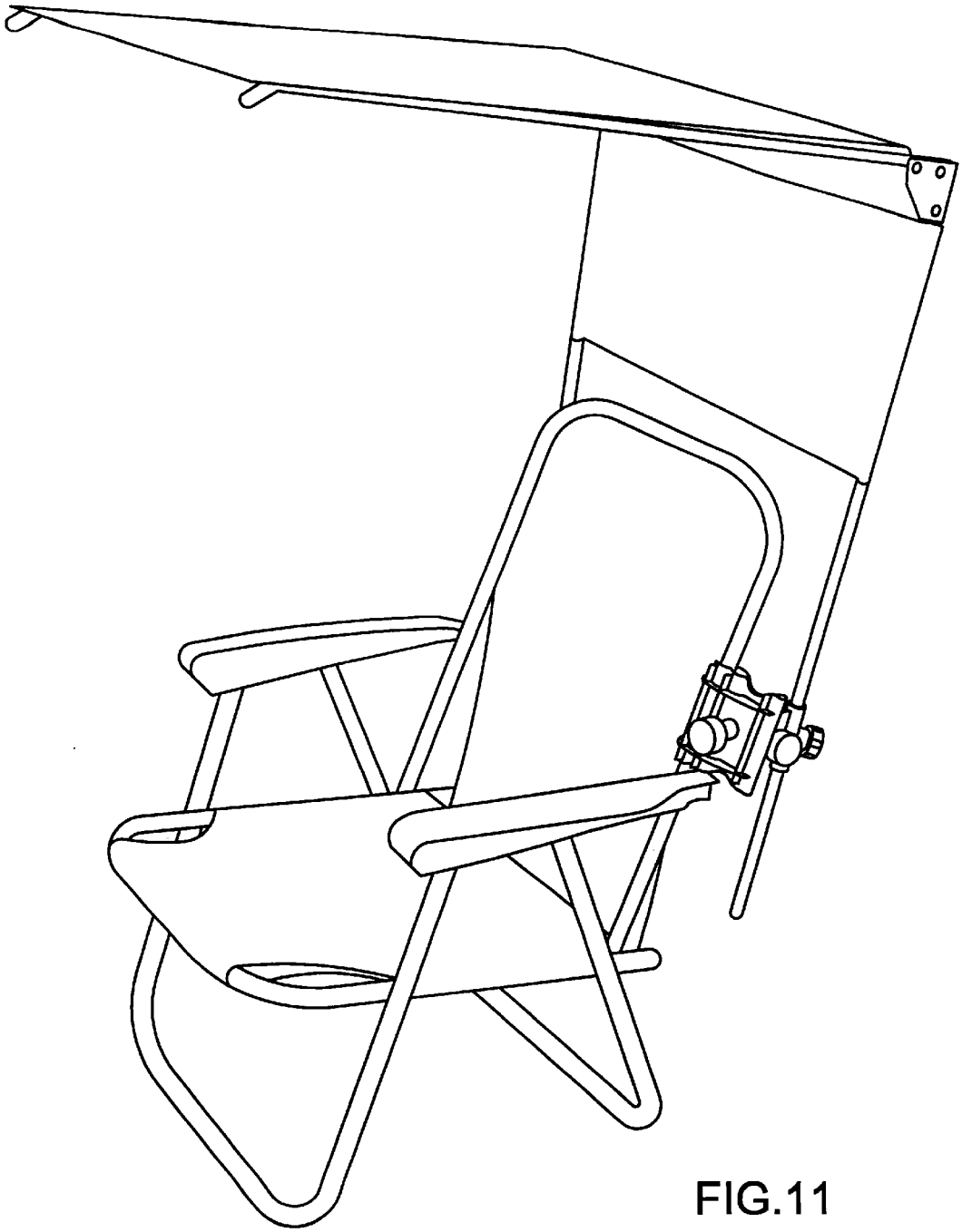
FIG. 11 is a perspective view of the improved collapsible sunshade attached to a small beach chair through use of the novel attachment means and oriented so that the awning is at a desired height and angle relative to the chair.
Figure 12:
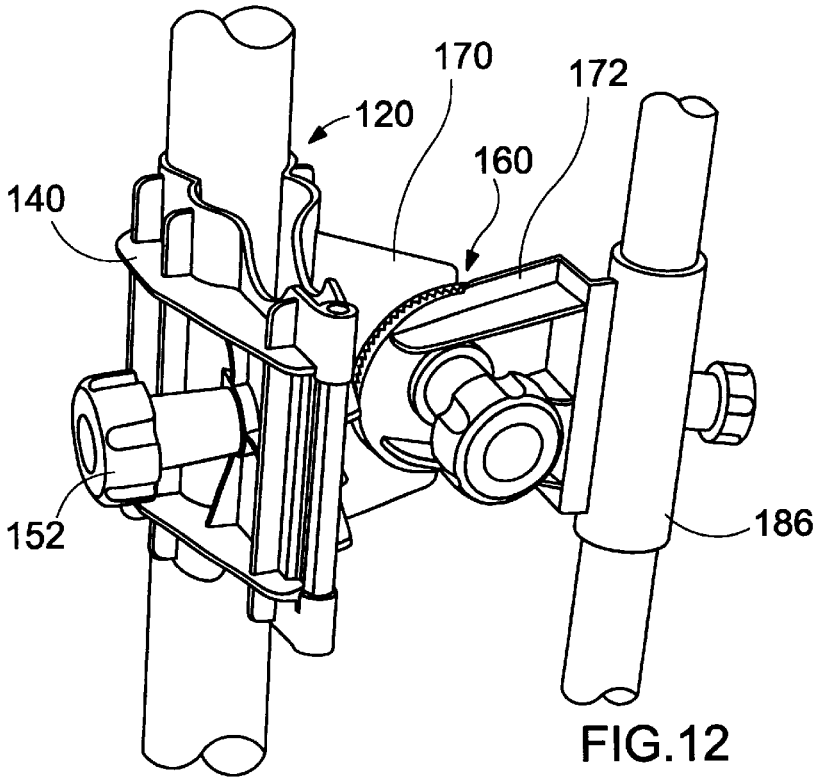
FIG. 12 is a perspective view of the novel attachment means of the present invention attached at one portion to a portion of a side frame of a chair and attached at another portion to the vertical leg of a sunshade apparatus.
Figure 15:
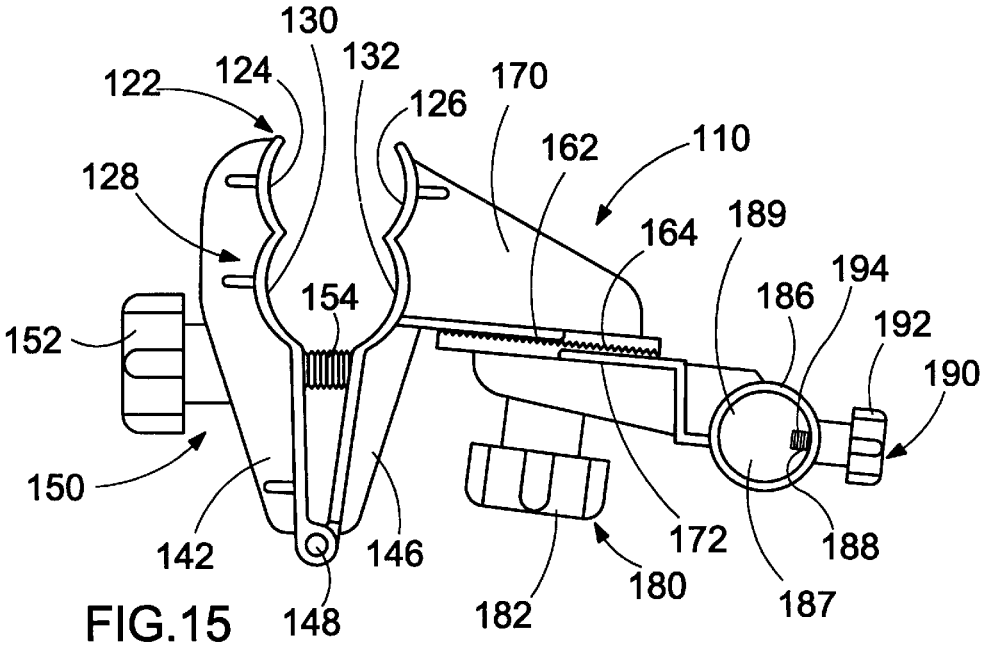
FIG. 15 is a top plan view of the novel attachment means of the present invention.

The first half 140 and the second half 144 are rotatably connected at their mating end by rotational attachment means 148. A first closing means which by way of example can be a threaded bolt 150 having a knob 152 and threads 154 can be unscrewed causing first half 140 and second half 144 to be rotated away from each other so that the bracket is open as illustrated in FIG. 15 and can be threaded closed so that the first half 140 and second half 144 can be brought closed together to clamp onto a side of a chair, as illustrated in FIGS. 11 and 12.

Figure 13:
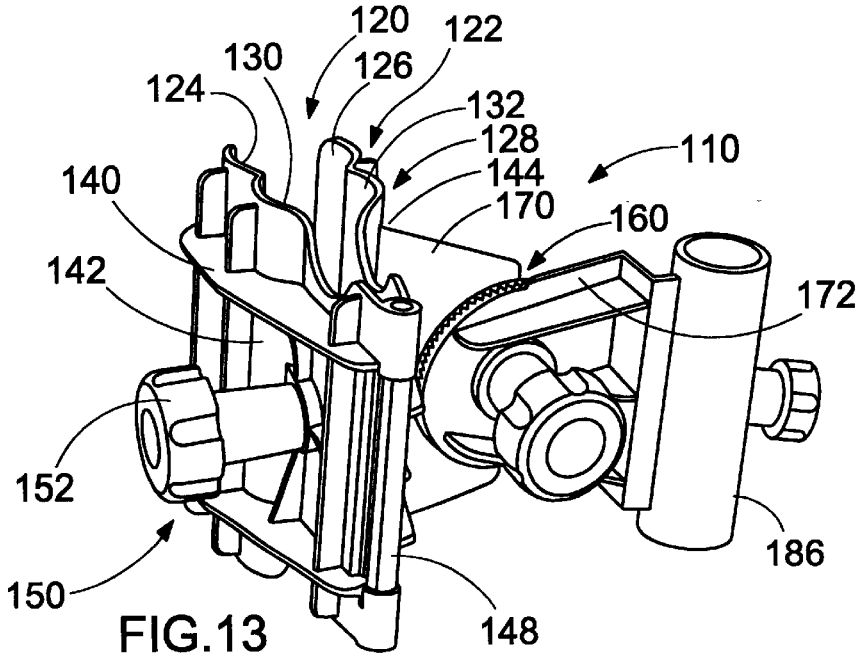
FIG. 13 is a perspective view of the novel attachment means of the present invention.
Figure 14:
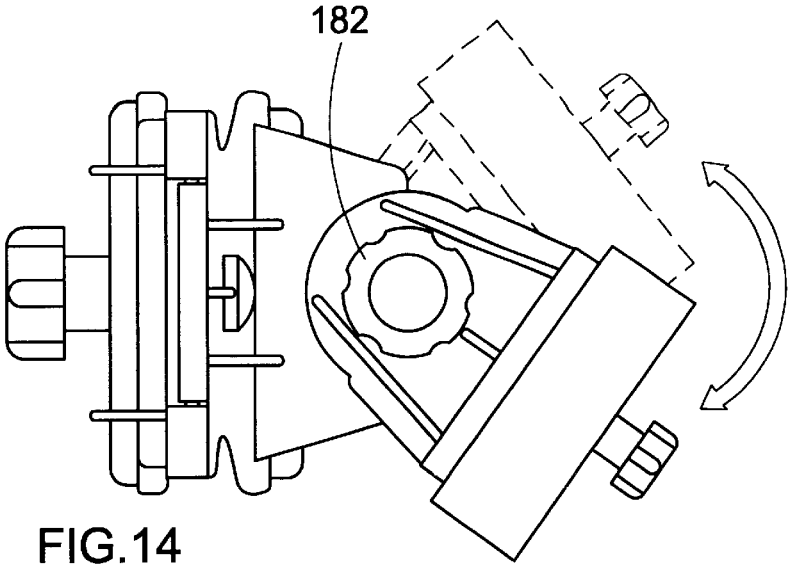
FIG. 14 is a side elevational view of the novel attachment means of the present invention with the ratchet mechanism causing the support member which supports the awning to be rotated at different angles.

The novel attachment means further comprises a rotatable ratchet member 160 with a first set of teeth 162 and a mating second set of teeth 164. As illustrated in FIGS. 13, 14 and 15, the first set of teeth 162 are located on the first body member 170 which extends transversely from the outer surfaces of the second outer elongated arcuate wall 126 and the second inner elongated arcuate wall 132. The second set of teeth 164 are located on a separate second body part 172.

The first body part 170 and the second body part 172 are connected together by a second closing means 180 which by way of example can be a thread bolt 180. The teeth 162 and 164 are brought into mating alignment and attached together by the threaded bolt 180. Since the first set of teeth 162 and the second set of teeth 164 each extend for 360 degrees, the orientation of the first set of teeth 162 onto the second set of teeth 164 can be at any angle.

The second body part 172 is attached to a cylindrical leg receiving member 186. Due to the 360 degree orientation of the mating teeth 162 and 164 of ratchet member 160, the cylindrical leg receiving member 186 can be rotated to any desired angle relative to the first body part 170 and the openable clamshell bracket member 120. As illustrated in FIG. 14, the second closing means can be opened by rotating the head 182 of the thread bolt 180 counterclockwise so the threads 184 (not shown) of the second thread bolt 180 enable the teeth 162 and 164 to be separated and rotated relative to each other to enable the cylindrical leg receiving member 186 to be oriented at any angle relative to the openable clamshell bracket member 120.

The cylindrical leg receiving member 186 has an adjustment means 190 which extends through a threaded opening 188. The adjustment means 190 can be a threaded bolt 190 having a head 192 and threads 194 which extend into the hollow interior 187 of the cylindrical leg receiving member 186 as illustrated in FIG. 15. Therefore, the vertical leg 292 of the sunshade apparatus can be inserted into the cylindrical leg receiving member 186 and adjusted to any desired height by tightening the adjustment means 190 so that the sunshade apparatus leg 292 is tightly pressed against the interior wall 189 of the cylindrical leg receiving member 186 at the desired location.

The attachment means can be made of any material which is plastic or metal.

The present invention also comprises a portable and collapsible sunshade apparatus 200 illustrated in FIGS. 16 through 19. The collapsible sunshade apparatus comprises a first horizontal bar 202 and a spaced apart parallel second horizontal bar 204. The first and second parallel horizontal bars are maintained in their parallel horizontal orientation by a pair of spreading bars. First spreading bar 206 comprises a first arm 208 and a second arm 210 which are rotatably jointed at their overlapping interior ends by a locking rivet 212. First arm 208 has an exterior end 214 which is rotatably attached to first horizontal bar 202 by a locking rivet 218. First arm 208 also has an interim end 216. Second arm 210 has an exterior end 220 which is rotatably attached to second horizontal bar 204 by a locking rivet 222. Second arm 210 also has an interior end 224. First and second arms 208 and 210 are rotatably joined at their interim ends by locking rivet 212.

Figure 17:
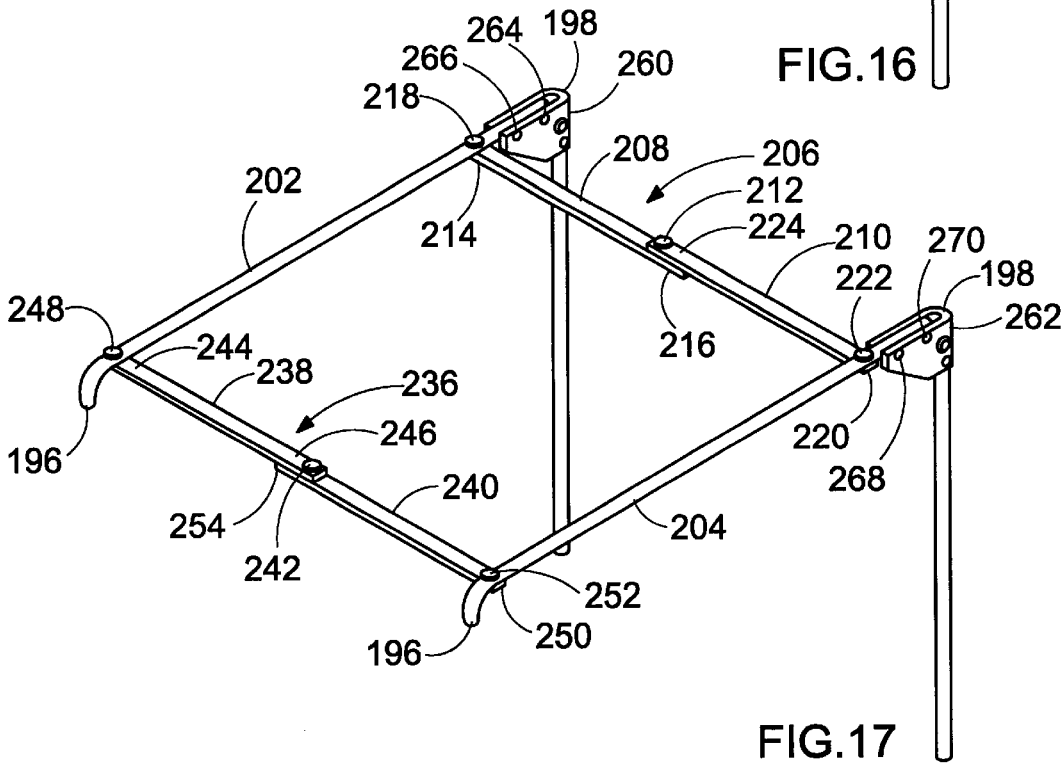
FIG. 17 is a perspective view of the framework of the improved collapsible sunshade apparatus of the present invention with the top awning and the back awning removed.

As illustrated in FIG. 17, the first spreading bar 206 is located adjacent the interior end 198 of horizontal bars 202 and 204. Located in spaced apart parallel relationship to the first spreading bar 206 but positioned adjacent the exterior end 196 of the horizontal bars 202 and 204 is a second spreading bar 236. Second spreading bar 236 comprises a first arm 238 and a second arm 240 which are rotatably joined at their overlapping interior ends by a locking rivet 242. First arm 238 has an exterior end 244 which is rotatably attached to first horizontal bar 202 by a locking rivet 248. First arm 238 also has an interior end 246. Second arm 240 has an exterior end 250 which is rotatably attached to second horizontal bar 204 by a locking rivet 252. Second arm 240 also has an interior end 254. First and second arms 238 and 240 are rotatably joined at their interior ends by locking rivet 242.

First horizontal bar 202 is attached adjacent interior end 198 to a first support bracket 260 and second horizontal bar 204 is attached adjacent its interior end 198 to a second support bracket 262. In the preferred embodiment, they are permanently attached by attachment means such as rivets 264, 266, 268 and 270 respectively.

Figure 18:
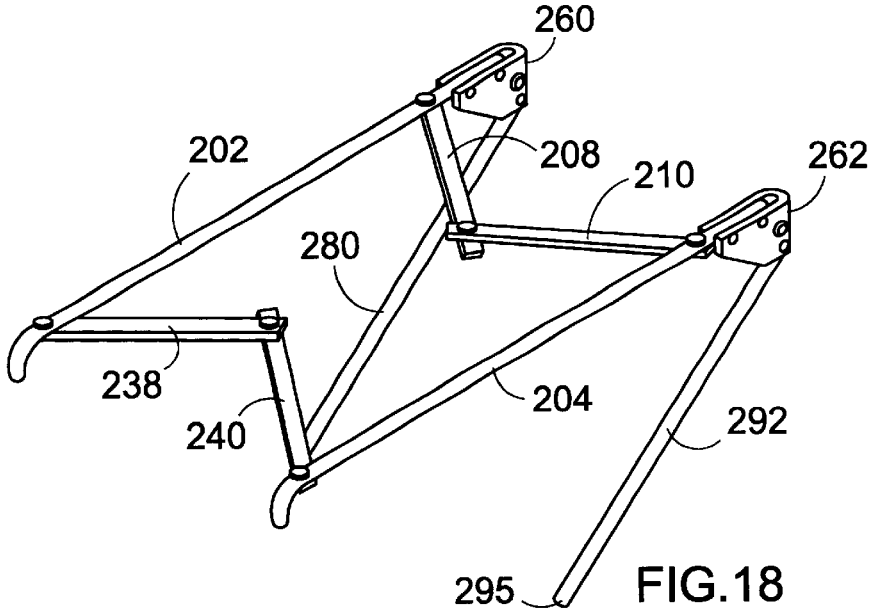
FIG. 18 is a perspective view showing the framework of the improved collapsible sunshade apparatus being collapsed for easy transportation.
Figure 19:
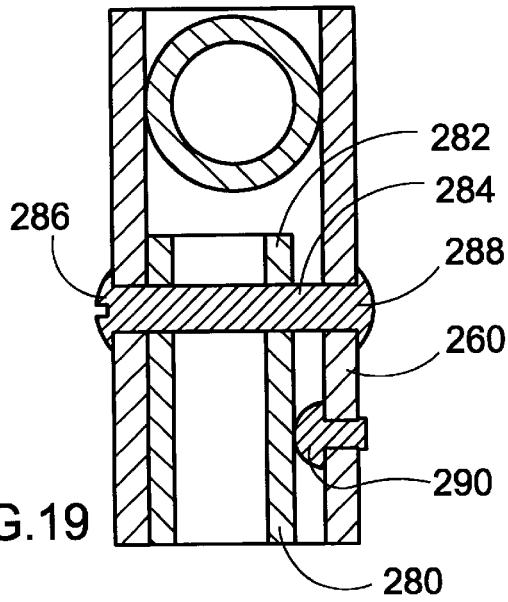
FIG. 19 is a cross-sectional view showing the folding collapsing mechanism of the sunshade apparatus.

Extending perpendicularly to first horizontal bar 202 is first vertical leg 280. At its interior end 282, first vertical leg 280 is rotatably attached to first support bracket 260 by a horizontal bar 284 which extends through the first vertical leg 280 and through the first support bracket 260 and which horizontal bar 284 terminates or ends in caps 286 and 288. A rivet pin 290 extending interiorly of at least one wall of the first support bracket forces first vertical leg 280 to be maintained in its vertical orientation. A rotational force can move the first vertical leg 280 past the rivet pin 290 to cause it to be folded against first horizontal bar 202 as illustrated in FIG. 18.

A similar structure rotatably supports second vertical leg 292 on second support bracket 262. Extending perpendicular to second horizontal bar 204 is a second vertical leg 292. At its interior end, second vertical leg 292 is rotatably attached to second support bracket 262 by a horizontal bar which extends through the second vertical leg 292 and through the second support bracket 262 and which horizontal bar terminates in end 295. A rivet pin extending interiorly of at least one wall of the second support bracket forces second vertical leg 292 to be maintained in its vertical orientation. A rotation force can move the second vertical leg 292 past the rivet pin to cause it to be folded against second horizontal bar 204 as illustrated in FIG. 18.

Figure 16:
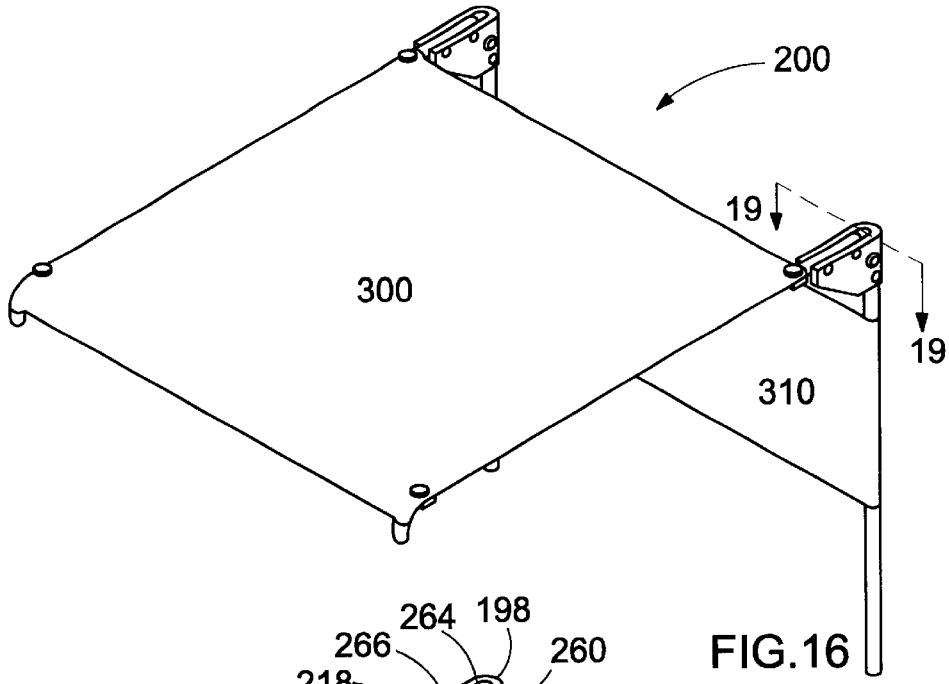
FIG. 16 is a perspective view of the improved collapsible sunshade apparatus of the present invention with the top awning and back awning in place.

A first shade member 300 (which by way of example only may be made of fabric) is supported by first horizontal bar 202 and second horizontal bar 204 and second shade member (which by way of example only may be made of fabric) is supported on first vertical leg 280 and second vertical leg 292 as illustrated in FIG. 16.

Defined in detail, the present invention is an attachment member for attaching the leg of a sunshade to the side of a chair, comprising: (a) an openable clamshell bracket member having an outer parallel arcuate member including a first elongated arcuate wall and a parallel second elongated arcuate wall, and an inner arcuate member having a first elongated arcuate wall and a parallel second elongated arcuate wall, the first elongated arcuate walls being adjacent each other and forming one half of the clamshell bracket and the second elongated arcuate walls being adjacent each other and forming the second half of the clamshell bracket, the two halves rotatably attached to each other, the clamshell bracket further having means to tighten the two halves against each other and to enable the halves to be opened; (b) a first body member extending away from the second outer and second inner arcuate walls, the first body member having a transverse wall which is perpendicular to the second inner arcuate wall, the transverse wall having a multiplicity of teeth on one surface; (c) a second body member having a transverse wall parallel to the transverse wall of the first body member, the transverse wall of the second body member having a multiplicity of mating teeth so that the teeth on the two transverse walls form a ratchet mechanism, and means to adjust and tighten the teeth against each other; and (d) the second body member terminating in a hollow cylindrical leg receiving member including a cylindrical wall and an adjustment means extending into the hollow portion of the cylindrical leg receiving member to fasten an inserted leg at any desired portion of the cylindrical leg receiving member; (e) whereby the attachment member is attached to the side of a chair by clamping either the parallel walls of the outer parallel arcuate member or the parallel walls of the inner parallel arcuate member around the side of a chair and fastening them against the side of the chair by adjusting the clamshell tightening means, the leg of a sunshade is affixed within the cylindrical leg receiving member and tightened to any desired height above the chair by the adjustment means, and the angle of the sunshade relative to the chair is adjusted by rotating the second body member relative to the first body member by the ratchet mechanism and tightening the two together at the desire orientation by the adjustment and tightening means.

Defined broadly, the present invention is an attachment member for attaching the leg of a sunshade to the side of a chair, comprising: (a) an openable clamshell bracket member having a first half rotatably attached to a second half, the two halves having mating inner parallel walls and mating outer parallel walls whereby one set of parallel walls can be clamped around the side of a chair, the clamshell bracket member further having means to tighten the two halves against each other and to enable the halves to be opened; (b) a first body member extending transversely to the clamshell bracket member and having a multiplicity of teeth on one side of its transverse wall; (c) a second body member having a transverse wall with mating teeth on its transverse wall to mate with the teeth on the transverse wall of the first body member to form a ratchet mechanism, and means to adjust and tighten the teeth against each other; and (d) the second body member terminating in a hollow cylindrical leg receiving member including a cylindrical wall and an adjustment means extending into the hollow portion of the cylindrical leg receiving member to fasten an inserted leg at any desired portion of the cylindrical leg receiving member.

Defined more broadly, the present invention is an attachment member for attaching the leg of a sunshade to the side of a chair, comprising: (a) an openable clamshell bracket member having a first half rotatably attached to a second half, the two halves having at least one pair of mating parallel walls which are clamped around the side of a chair, the clamshell bracket member further having means to tighten the two halves against each other and to enable the halves to be opened; (b) a first body member extending from one half of the clamshell bracket member and having a wall with a multiplicity of teeth on one surface; (c) a second body member having a wall with a multiplicity of teeth on one surface which mate with the teeth on the first body member to form a ratchet mechanism, and means to adjust and tighten the teeth against each other; and (d) the second body further comprising a cylinder with a hollow interior into which a leg of a sunshade is inserted, and an adjustment means by which the inserted leg can be fastened within the cylinder at any desired location along the length of the leg.

Defined alternatively in detail, the present invention is a portable and collapsible sunshade apparatus comprising: (a) a first horizontal bar and a second parallel horizontal bar, the bars maintained in their parallel horizontal orientation by a pair of spaced apart spreading bars including a first and second spreading bar; (b) said first spreading bar having a first arm and a second arm, the first arm rotatably attached at its exterior end to the first horizontal bar, the second arm rotatably attached at its exterior end to the second horizontal bar, and the two arms rotatably attached to each other at their overlapping interior ends; (c) said second spreading bar spaced apart from the first spreading bar, the second spreading bar having a first arm and a second arm, the first arm rotatably attached at its exterior end to the first horizontal bar, the second arm rotatably attached at its exterior end to the second horizontal bar, and the two arms rotatably attached to each other at their overlapping interior ends; (d) a first support bracket attached at one end of the first horizontal bar and a parallel second support bracket attached at one end of the second horizontal bar, a first vertical leg rotatably attached to the first support bracket, the bracket including orientation means to cause the first vertical leg to extend perpendicular to the first horizontal bar and a second vertical leg rotatably attached to the second support bracket, the bracket including orientation means to cause the second vertical leg to extend perpendicular to the second horizontal bar and parallel to the first vertical leg; and (e) a first shade member supported between the first and second horizontal bars and a second shade member supported between the first and second vertical legs.

Defined broadly, the present invention is a portable and collapsible sunshade apparatus comprising: (a) a first horizontal bar and a second parallel horizontal bar, the bars maintained in their parallel horizontal orientation by a pair of spaced apart spreading bars including a first and second spreading bar; (b) said first spreading bar having a first arm and a second arm, the first arm rotatably attached at its exterior end to the first horizontal bar, the second arm rotatably attached at its exterior end to the second horizontal bar, and the two arms rotatably attached to each other at their overlapping interior ends; (c) said second spreading bar spaced apart from the first spreading bar, the second spreading bar having a first arm and a second arm, the first arm rotatably attached at its exterior end to the first horizontal bar, the second arm rotatably attached at its exterior end to the second horizontal bar, and the two arms rotatably attached to each other at their overlapping interior ends; and (d) a first support bracket attached at one end of the first horizontal bar and a parallel second support bracket attached at one end of the second horizontal bar, a first vertical leg rotatably attached to the first support bracket, the bracket including orientation means to cause the first vertical leg to extend perpendicular to the first horizontal bar and a second vertical leg rotatably attached to the second support bracket, the bracket including orientation means to cause the second vertical leg to extend perpendicular to the second horizontal bar and parallel to the first vertical leg.

Defined more broadly, the present invention is a portable and collapsible sunshade apparatus comprising: (a) a first horizontal bar and a second parallel horizontal bar, the bars maintained in their parallel orientation by a first spreading bar attached adjacent parallel locations of the horizontal bars and a second spreading bar attached adjacent parallel locations on the horizontal bars and at locations spaced apart from the attachment of the first spreading bar; (b) the first spreading bar rotatably attached to the horizontal bars and having means on the interior of the spreading bars by which the spreading bar is rotated to a fixed position to cause the horizontal bar to be spread apart and by which the spreading bar is rotated so the two horizontal bars are adjacent each other; (c) the second spreading bar rotatably attached to the horizontal bars and having means on the interior of the spreading bar by which the spreading bar is rotated to a fixed position to cause the horizontal bars to be spread apart and by which the spreading bar is rotated so the two horizontal bars are adjacent each other; (d) a first support bracket attached at one end of the first horizontal bar and a parallel second support bracket attached at one end of the second horizontal bar, a first vertical leg rotatably attached to the first support bracket, the bracket including means to cause the first vertical leg to extend perpendicular to the first horizontal bar and a second vertical leg rotatably attached to the second support bracket, the bracket including means to cause the second vertical leg to extend perpendicular to the second horizontal bar and parallel to the first vertical leg; (e) a first shade member supported between the first and second horizontal bars and a second shade member supported between the first and second vertical legs.

Defined more broadly, the present invention is a portable and collapsible sunshade apparatus comprising: (a) a first horizontal bar and a second parallel horizontal bar, the bars maintained in their parallel orientation by a first spreading bar attached adjacent parallel locations of the horizontal bars and a second spreading bar attached adjacent parallel locations on the horizontal bars and at locations spaced apart from the attachment of the first spreading bar; (b) the first spreading bar rotatably attached to the horizontal bars and having means on the interior of the spreading bars by which the spreading bar is rotated to a fixed position to cause the horizontal bar to be spread apart and by which the spreading bar is rotated so the two horizontal bars are adjacent each other; (c) the second spreading bar rotatably attached to the horizontal bars and having means on the interior of the spreading bar by which the spreading bar is rotated to a fixed position to cause the horizontal bars to be spread apart and by which the spreading bar is rotated so the two horizontal bars are adjacent each other; and (d) a first support bracket attached at one end of the first horizontal bar and a parallel second support bracket attached at one end of the second horizontal bar, a first vertical leg rotatably attached to the first support bracket, the bracket including means to cause the first vertical leg to extend perpendicular to the first horizontal bar and a second vertical leg rotatably attached to the second support bracket, the bracket including means to cause the second vertical leg to extend perpendicular to the second horizontal bar and parallel to the first vertical leg.

In addition, the present invention is the combination of an attachment member for attaching the leg of a sunshade to the side of a chair and a portable and collapsible sunshade apparatus, comprising: (a) an openable clamshell bracket member having an outer parallel arcuate member including a first elongated arcuate wall and a parallel second elongated arcuate wall, and an inner arcuate member having a first elongated arcuate wall and a parallel second elongated arcuate wall, the first elongated arcuate walls being adjacent each other and forming one half of the clamshell bracket and the second elongated arcuate walls being adjacent each other and forming the second half of the clamshell bracket, the two halves rotatably attached to each other, the clamshell bracket further having means to tighten the two halves against each other and to enable the halves to be opened; (b) a first body member extending away from the second outer and second inner arcuate walls, the first body member having a transverse wall which is perpendicular to the second interior inner arcuate wall, the transverse wall having a multiplicity of teeth on one surface; (c) a second body member having a transverse wall parallel to the transverse wall of the first body member, the transverse wall of the second body member having a multiplicity of mating teeth so that the teeth on the two transverse walls form a ratchet mechanism, and means to adjust and tighten the teeth against each other; (d) the second body member terminating in a hollow cylindrical leg receiving member including a cylindrical wall and an adjustment means extending into the hollow portion of the cylindrical leg receiving member to fasten an inserted leg at any desired portion of the cylindrical leg receiving member; (e) a first horizontal bar and a second parallel horizontal bar, the bars maintained in their parallel horizontal orientation by a pair of spaced apart spreading bars including a first and second spreading bar; (f) said first spreading bar having a first arm and a second arm, the first arm rotatably attached at its exterior end to the first horizontal bar, the second arm rotatably attached at its exterior end to the second horizontal bar, and the two arms rotatably attached to each other at their overlapping interior ends; (g) said second spreading bar spaced apart from the first spreading bar, the second spreading bar having a first arm and a second arm, the first arm rotatably attached at its exterior end to the first horizontal bar, the second arm rotatably attached at its exterior end to the second horizontal bar, and the two arms rotatably attached to each other at their overlapping interior ends; (h) a first support bracket attached at one end of the first horizontal bar and a parallel second support bracket attached at one end of the second horizontal bar, a first vertical leg rotatably attached to the first support bracket, the bracket including orientation means to cause the first vertical leg to extend perpendicular to the first horizontal bar and a second vertical leg rotatably attached to the second support bracket, the bracket including orientation means to cause the second vertical leg to extend perpendicular to the second horizontal bar and parallel to the first vertical leg; and (i) a first shade member supported between the first and second horizontal bars and a second shade member supported between the first and second vertical legs; (j) whereby the attachment member is attached to the side of a chair by clamping either the parallel walls of the outer arcuate member or the parallel walls of the inner arcuate member around the side of a chair and fastening them against the side of a chair by adjusting the clamshell tightening means, and one of the two vertical legs of the portable and collapsible sunshade apparatus is affixed within the cylindrical leg receiving member and tightened to any desired height above the chair by the adjustment means, and the angle of the shade members relative to the chair is adjusted by rotating the second body member relative to the first body member by the ratchet mechanism and tightening the two together at the desired amount by the adjustment and tightening means.

In addition, the present invention is the combination of an attachment member for attaching the leg of an awning to the side of a chair and a portable and collapsible sunshade apparatus, comprising: (a) an openable clamshell bracket member having a first half rotatably attached to a second half, the two halves having mating inner parallel walls and mating outer parallel walls whereby one set of parallel walls can be clamped around the side of a chair, the clamshell bracket member further having means to tighten the two halves against each other and to enable the halves to be opened; (b) a first body member extending transversely to the clamshell bracket member and having a multiplicity of teeth on one side of its transverse wall; (c) a second body member having a transverse wall with mating teeth on its transverse wall to mate with the teeth on the transverse wall of the first body member to form a ratchet mechanism, and means to adjust and tighten the teeth against each other; (d) the second body member terminating in a hollow cylindrical leg receiving member including a cylindrical wall and an adjustment means extending into the hollow portion of the cylindrical leg receiving member to fasten an inserted leg at any desired portion of the cylindrical leg receiving member; (e) a first horizontal bar and a second parallel horizontal bar, the bars maintained in their parallel orientation by a first spreading bar attached adjacent parallel locations of the horizontal bars and a second spreading bar attached adjacent parallel locations on the horizontal bars and at locations spaced apart from the attachment of the first spreading bar; (f) the first spreading bar rotatably attached to the horizontal bars and having means on the interior of the spreading bars by which the spreading bar is rotated to a fixed position to cause the horizontal bar to be spread apart and by which the spreading bar is rotated so the two horizontal bars are adjacent each other; (g) the second spreading bar rotatably attached to the horizontal bars and having means on the interior of the spreading bar by which the spreading bar is rotated to a fixed position to cause the horizontal bars to be spread apart and by which the spreading bar is rotated so the two horizontal bars are adjacent each other; (h) a first support bracket attached at one end of the first horizontal bar and a parallel second support bracket attached at one end of the second horizontal bar, a first vertical leg rotatably attached to the first support bracket, the bracket including means to cause the first vertical leg to extend perpendicular to the first horizontal bar and a second vertical leg rotatably attached to the second support bracket, the bracket including means to cause the second vertical leg to extend perpendicular to the second horizontal bar and parallel to the first vertical leg; and (i) a first shade member supported between the first and second horizontal bars and a second shade member supported between the first and second vertical legs; (1) whereby the attachment member is attached to the side of a chair by clamping either the parallel walls of the outer arcuate member or the parallel walls of the inner arcuate member around the side of a chair and fastening them against the side of a chair by adjusting the clamshell tightening means, and one of the two vertical legs of the portable and collapsible sunshade apparatus is affixed within the cylindrical leg receiving member and tightened to any desired height above the chair by the adjustment means, and the angle of the shade members to the chair is adjusted by rotating the second body member relative to the first body member by the ratchet mechanism and tightening the two together at the desired amount by the adjustment and tightening means.

In addition, the present invention is the combination of an attachment member for attaching the leg of an awning to the side of a chair and a portable and collapsible sunshade apparatus, comprising: (a) an openable clamshell bracket member having a first half rotatably attached to a second half, the two halves having at least one pair of mating parallel walls which are clamped around the side of a chair, the clamshell bracket member further having means to tighten the two halves against each other and to enable the halves to be opened; (b) a first body member extending from one half of the clamshell bracket member and having a wall with a multiplicity of teeth on one surface; (c) a second body member having a wall with a multiplicity of teeth on one surface which mate with the teeth on the first body member to form a ratchet mechanism, and means to adjust and tighten the teeth against each other; (d) the second body further comprising a cylinder with a hollow interior into which a leg of an sunshade apparatus is inserted, and an adjustment means by which the inserted leg can be fastened within the cylinder at any desired location along the length of the leg; (e) a first horizontal bar and a second parallel horizontal bar, the bars maintained in their parallel orientation by a first spreading bar attached adjacent parallel locations of the horizontal bars and a second spreading bar attached adjacent parallel locations on the horizontal bars and at locations spaced apart from the attachment of the first spreading bar; (f) the first spreading bar rotatably attached to the horizontal bars and having means on the interior of the spreading bars by which the spreading bar is rotated to a fixed position to cause the horizontal bar to be spread apart and by which the spreading bar is rotated so the two horizontal bars are adjacent each other; (g) the second spreading bar rotatably attached to the horizontal bars and having means on the interior of the spreading bar by which the spreading bar is rotated to a fixed position to cause the horizontal bars to be spread apart and by which the spreading bar is rotated so the two horizontal bars are adjacent each other; (h) a first support bracket attached at one end of the first horizontal bar and a parallel second support bracket attached at one end of the second horizontal bar, a first vertical leg rotatably attached to the first support bracket, the bracket including means to cause the first vertical leg to extend perpendicular to the first horizontal bar and a second vertical leg rotatably attached to the second support bracket, the bracket including means to cause the second vertical leg to extend perpendicular to the second horizontal bar and parallel to the first vertical leg; and (i) a shade member supported between the first and second horizontal bars; (j) whereby the attachment member is attached to the side of a chair by clamping the at least one pair of mating parallel walls around the side of a chair and fastening them against the side of a chair by adjusting the clamshell tightening means, and one of the two vertical legs of the portable and collapsible sunshade apparatus is affixed within the cylindrical leg receiving member and tightened to any desired height above the chair by the adjustment means, and the angle of the shade member to the chair is adjusted by rotating the second body member relative to the first body member by the ratchet mechanism and tightening the two together at the desired amount by the adjustment and tightening means.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. An attachment member for attaching the leg of a sunshade to the side of a chair, comprising:

a. an openable clamshell bracket member having an outer parallel arcuate member including a first elongated arcuate wall and a parallel second elongated arcuate wall, and an inner arcuate member having a first elongated arcuate wall and a parallel second elongated arcuate wall, the first elongated arcuate walls being adjacent each other and forming one half of the clamshell bracket and the second elongated arcuate walls being adjacent each other and forming the second half of the clamshell bracket, the two halves rotatably attached to each other, the clamshell bracket further having means to tighten the two halves against each other and to enable the halves to be opened;

b. a first body member extending away from the second outer and second inner arcuate walls, the first body member having a transverse wall which is perpendicular to the second inner arcuate wall, the transverse wall having a multiplicity of teeth on one surface;

c. a second body member having a transverse wall parallel to the transverse wall of the first body member, the transverse wall of the second body member having a multiplicity of mating teeth so that the teeth on the two transverse walls form a ratchet mechanism, and means to adjust and tighten the teeth against each other; and d. the second body member terminating in a hollow cylindrical leg receiving member including a cylindrical wall and an adjustment means extending into the hollow portion of the cylindrical leg receiving member to fasten an inserted leg at any desired portion of the cylindrical leg receiving member;

e. whereby the attachment member is attached to the side of a chair by clamping either the parallel walls of the outer parallel arcuate member or the parallel walls of the inner parallel arcuate member around the side of a chair and fastening them against the side of the chair by adjusting the clamshell tightening means, the leg of a sunshade is affixed within the cylindrical leg receiving member and tightened to any desired height above the chair by the adjustment means, and the angle of the sunshade relative to the chair is adjusted by rotating the second body member relative to the first body member by the ratchet mechanism and tightening the two together at the desire orientation by the adjustment and tightening means.

2. The attachment member in accordance with claim 1, wherein the means to tighten the two halves of the clamshell bracket together comprises a threaded bolt extending through the clamshell member.

3. The attachment member in accordance with claim 1, wherein the means to adjust and tighten the ratchet mechanism further comprises a threaded bolt extending through the ratchet mechanism.

4. The attachment member in accordance with claim 1, wherein the adjustment means on the cylindrical leg receiving member further comprises a threaded bolt extending through the wall of the cylinder and into the hollow area in the cylinder.

5. The attachment member in accordance with claim 1, wherein the attachment mechanism is made of plastic.

6. An attachment member for attaching the leg of a sunshade to the side of a chair, comprising:

a. an openable clamshell bracket member having a first half rotatably attached to a second half, the two halves having mating inner parallel walls and mating outer parallel walls whereby one set of parallel walls, can be clamped around the side of a chair, the clamshell bracket member further having means to tighten the two halves against each other and to enable the halves to be opened;

b. a first body member extending transversely to the clamshell bracket member and having a multiplicity of teeth on one side of its transverse wall;

c. a second body member having a transverse wall with mating teeth on its transverse wall to mate with the teeth on the transverse wall of the first body member to form a ratchet mechanism, and means to adjust and tighten the teeth against each other; and d. the second body member terminating in a hollow cylindrical leg receiving member including a cylindrical wall and an adjustment means extending into the hollow portion of the cylindrical leg receiving member to fasten an inserted leg at any desired portion of the cylindrical leg receiving member.

7. The attachment member in accordance with claim 6, wherein the means to tighten the two halves of the clamshell bracket together comprises a threaded bolt extending through the clamshell member.

8. The attachment member in accordance with claim 6, wherein the means to adjust and tighten the ratchet mechanism further comprises a threaded bolt extending through the ratchet mechanism.

9. The attachment member in accordance with claim 6, wherein the adjustment means on the cylindrical leg receiving member further comprises a threaded bolt extending through the wall of the cylinder and into the hollow area in the cylinder.

10. The attachment member in accordance with claim 6, wherein the attachment mechanism is made of plastic.

11. An attachment member for attaching the leg of a sunshade to the side of a chair, comprising:

a. an openable clamshell bracket member having a first half rotatably attached to a second half, the two halves having at least one pair of mating parallel walls which are clamped around the side of a chair, the clamshell bracket member further having means to tighten the two halves against each other and to enable the halves to be opened;

b. a first body member extending from one half of the clamshell bracket member and having a wall with a multiplicity of teeth on one surface;

c. a second body member having a wall with a multiplicity of teeth on one surface which mate with the teeth on the first body member to form a ratchet mechanism, and means to adjust and tighten the teeth against each other; and d. the second body further comprising a cylinder with a hollow interior into which a leg of a sunshade is inserted, and an adjustment means by which the inserted leg can be fastened within the cylinder at any desired location along the length of the leg.

12. The attachment member in accordance with claim 11, wherein the means to tighten the two halves of the clamshell bracket together comprises a threaded bolt extending through the clamshell member.

13. The attachment member in accordance with claim 11, wherein the means to adjust and tighten the ratchet mechanism further comprises a threaded bolt extending through the ratchet mechanism.

14. The attachment member in accordance with claim 11, wherein the adjustment means on the cylinder further comprises a threaded bolt extending through the wall of the cylinder and into the hollow interior in the cylinder.

15. The attachment member in accordance with claim 11, wherein the attachment mechanism is made of plastic.

16. A portable and collapsible sunshade apparatus comprising:

a. a first horizontal bar and a second parallel horizontal bar, the bars maintained in their parallel horizontal orientation by a pair of spaced apart spreading bars including a first and second spreading bar;

b. said first spreading bar having a first arm and a second arm, the first arm rotatably attached at its exterior end to the first horizontal bar, the second arm rotatably attached at its exterior end to the second horizontal bar, and the two arms rotatably attached to each other at their overlapping interior ends;

c. said second spreading bar spaced apart from the first spreading bar, the second spreading bar having a first arm and a second arm, the first arm rotatably attached at its exterior end to the first horizontal bar, the second arm rotatably attached at its exterior end to the second horizontal bar, and the two arms rotatably attached to each other at their overlapping interior ends;

d. a first support bracket attached at one end of the first horizontal bar and a parallel second support bracket attached at one end of the second horizontal bar, a first vertical leg rotatably attached to the first support bracket, the bracket including orientation means to cause the first vertical leg to extend perpendicular to the first horizontal bar and a second vertical leg rotatably attached to the second support bracket, the bracket including orientation means to cause the second vertical leg to extend perpendicular to the second horizontal bar and parallel to the first vertical leg; and e. a first shade member supported between the first and second horizontal bars and a second shade member supported between the first and second vertical legs.

17. A portable and collapsible sunshade apparatus comprising:

a. a first horizontal bar and a second parallel horizontal bar, the bars maintained in their parallel horizontal orientation by a pair of spaced apart spreading bars including a first and second spreading bar;

b. said first spreading bar having a first arm and a second arm, the first arm rotatably attached at its exterior end to the first horizontal bar, the second arm rotatably attached at its exterior end to the second horizontal bar, and the two arms rotatably attached to each other at their overlapping interior ends;

c. said second spreading bar spaced apart from the first spreading bar, the second spreading bar having a first arm and a second arm, the first arm rotatably attached at its exterior end to the first horizontal bar, the second arm rotatably attached at its exterior end to the second horizontal bar, and the two arms rotatably attached to each other at their overlapping interior ends; and d. a first support bracket attached at one end of the first horizontal bar and a parallel second support bracket attached at one end of the second horizontal bar, a first vertical leg rotatably attached to the first support bracket, the bracket including orientation means to cause the first vertical leg to extend perpendicular to the first horizontal bar and a second vertical leg rotatably attached to the second support bracket, the bracket including orientation means to cause the second vertical leg to extend perpendicular to the second horizontal bar and parallel to the first vertical leg.

18. A portable and collapsible sunshade apparatus in accordance with claim 17, further comprising a first shade member supported between the first and second horizontal bars.

19. A portable and collapsible sunshade apparatus in accordance with claim 18, further comprising a second shade member supported between the first and second vertical legs.

20. A portable and collapsible sunshade apparatus comprising:

a. a first horizontal bar and a second parallel horizontal bar, the bars maintained in their parallel orientation by a first spreading bar attached adjacent parallel locations of the horizontal bars and a second spreading bar attached adjacent parallel locations on the horizontal bars and at locations spaced apart from the attachment of the first spreading bar;

b. the first spreading bar rotatably attached to the horizontal bars and having means on the interior of the spreading bars by which the spreading bar is rotated to a fixed position to cause the horizontal bar to be spread apart and by which the spreading bar is rotated so the two horizontal bars are adjacent each other;

c. the second spreading bar rotatably attached to the horizontal bars and having means on the interior of the spreading bar by which the spreading bar is rotated to a fixed position to cause the horizontal bars to be spread apart and by which the spreading bar is rotated so the two horizontal bars are adjacent each other;

d. a first support bracket attached at one end of the first horizontal bar and a parallel second support bracket attached at one end of the second horizontal bar, a first vertical leg rotatably attached to the first support bracket, the bracket including means to cause the first vertical leg to extend perpendicular to the first horizontal bar and a second vertical leg rotatably attached to the second support bracket, the bracket including means to cause the second vertical leg to extend perpendicular to the second horizontal bar and parallel to the first vertical leg;

e. a first shade member supported between the first and second horizontal bars and a second shade member supported between the first and second vertical legs.

21. A portable and collapsible sunshade apparatus comprising:

a. a first horizontal bar and a second parallel horizontal bar, the bars maintained in their parallel orientation by a first spreading bar attached adjacent parallel locations of the horizontal bars and a second spreading bar attached adjacent parallel locations on the horizontal bars and at locations spaced apart from the attachment of the first spreading bar;

b. the first spreading bar rotatably attached to the horizontal bars and having means on the interior of the spreading bars by which the spreading bar is rotated to a fixed position to cause the horizontal bar to be spread apart and by which the spreading bar is rotated so the two horizontal bars are adjacent each other;

c. the second spreading bar rotatably attached to the horizontal bars and having means on the interior of the spreading bar by which the spreading bar is rotated to a fixed position to cause the horizontal bars to be spread apart and by which the spreading bar is rotated so the two horizontal bars are adjacent each other; and d. a first support bracket attached at one end of the first horizontal bar and a parallel second support bracket attached at one end of the second horizontal bar, a first vertical leg rotatably attached to the first support bracket, the bracket including means to cause the first vertical leg to extend perpendicular to the first horizontal bar and a second vertical leg rotatably attached to the second support bracket, the bracket including means to cause the second vertical leg to extend perpendicular to the second horizontal bar and parallel to the first vertical leg.

22. A portable and collapsible sunshade apparatus in accordance with claim 21, further comprising a first shade member supported between the first and second horizontal bars.

23. A portable and collapsible sunshade apparatus in accordance with claim 22, further comprising a second shade member supported between the first and second vertical legs.

24. The combination of an attachment member for attaching the leg of a sunshade to the side of a chair and a portable and collapsible sunshade apparatus, comprising:

a. an openable clamshell bracket member having an outer parallel arcuate member including a first elongated arcuate wall and a parallel second elongated arcuate wall, and an inner arcuate member having a first elongated arcuate wall and a parallel second elongated arcuate wall, the first elongated arcuate walls being adjacent each other and forming one half of the clamshell bracket and the second elongated arcuate walls being adjacent each other and forming the second half of the clamshell bracket, the two halves rotatably attached to each other, the clamshell bracket further having means to tighten the two halves against each other and to enable the halves to be opened;

b. a first body member extending away from the second outer and second inner arcuate walls, the first body member having a transverse wall which is perpendicular to the second inner arcuate wall, the transverse wall having a multiplicity of teeth on one surface;

c. a second body member having a transverse wall parallel to the transverse wall of the first body member, the transverse wall of the second body member having a multiplicity of mating teeth so that the teeth on the two transverse walls form a ratchet mechanism, and means to adjust and tighten the teeth against each other;

d. the second body member terminating in a hollow cylindrical leg receiving member including a cylindrical wall and an adjustment means extending into the hollow portion of the cylindrical leg receiving member to fasten an inserted leg at any desired portion of the cylindrical leg receiving member;

e. a first horizontal bar and a second parallel horizontal bar, the bars maintained in their parallel horizontal orientation by a pair of spaced apart spreading bars including a first and second spreading bar;

f. said first spreading bar having a first arm and a second arm, the first arm rotatably attached at its exterior end to the first horizontal bar, the second arm rotatably attached at its exterior end to the second horizontal bar, and the two arms rotatably attached to each other at their overlapping interior ends;

g. said second spreading bar spaced apart from the first spreading bar, the second spreading bar having a first arm and a second arm, the first arm rotatably attached at its exterior end to the first horizontal bar, the second arm rotatably attached at its exterior end to the second horizontal bar, and the two arms rotatably attached to each other at their overlapping interior ends;

h. a first support bracket attached at one end of the first horizontal bar and a parallel second support bracket attached at one end of the second horizontal bar, a first vertical leg rotatably attached to the first support bracket, the bracket including orientation means to cause the first vertical leg to extend perpendicular to the first horizontal bar and a second vertical leg rotatably attached to the second support bracket, the bracket including orientation means to cause the second vertical leg to extend perpendicular to the second horizontal bar and parallel to the first vertical leg; and i. a first shade member supported between the first and second horizontal bars and a second shade member supported between the first and second vertical legs;

j. whereby the attachment member is attached to the side of a chair by clamping either the parallel walls of the outer arcuate member or the parallel walls of the inner arcuate member around the side of a chair and fastening them against the side of a chair by adjusting the clamshell tightening means, and one of the two vertical legs of the portable and collapsible sunshade apparatus is affixed within the cylindrical leg receiving member and tightened to any desired height above the chair by the adjustment means, and the angle of the shade members relative to the chair is adjusted by rotating the second body member relative to the first body member by the ratchet mechanism and tightening the two together at the desired amount by the adjustment and tightening means.

25. The combination of an attachment member for attaching the leg of an awning to the side of a chair and a portable and collapsible sunshade apparatus, comprising:

a. an openable clamshell bracket member having a first half rotatably attached to a second half, the two halves having mating inner parallel walls and mating outer parallel walls whereby one set of parallel walls can be clamped around the side of a chair, the clamshell bracket member further having means to tighten the two halves against each other and to enable the halves to be opened;

b. a first body member extending transversely to the clamshell bracket member and having a multiplicity of teeth on one side of its transverse wall;

c. a second body member having a transverse wall with mating teeth on its transverse wall to mate with the teeth on the transverse wall of the first body member to form a ratchet mechanism, and means to adjust and tighten the teeth against each other;

d. the second body member terminating in a hollow cylindrical leg receiving member including a cylindrical wall and an adjustment means extending into the hollow portion of the cylindrical leg receiving member to fasten an inserted leg at any desired portion of the cylindrical leg receiving member;

e. a first horizontal bar and a second parallel horizontal bar, the bars maintained in their parallel orientation by a first spreading bar attached adjacent parallel locations of the horizontal bars and a second spreading bar attached adjacent parallel locations on the horizontal bars and at locations spaced apart from the attachment of the first spreading bar;

f. the first spreading bar rotatably attached to the horizontal bars and having means on the interior of the spreading bars by which the spreading bar is rotated to a fixed position to cause the horizontal bar to be spread apart and by which the spreading bar is rotated so the two horizontal bars are adjacent each other;

g. the second spreading bar rotatably attached to the horizontal bars and having means on the interior of the spreading bar by which the spreading bar is rotated to a fixed position to cause the horizontal bars to be spread apart and by which the spreading bar is rotated so the two horizontal bars are adjacent each other;

h. a first support bracket attached at one end of the first horizontal bar and a parallel second support bracket attached at one end of the second horizontal bar, a first vertical leg rotatably attached to the first support bracket, the bracket including means to cause the first vertical leg to extend perpendicular to the first horizontal bar and a second vertical leg rotatably attached to the second support bracket, the bracket including means to cause the second vertical leg to extend perpendicular to the second horizontal bar and parallel to the first vertical leg; and i. a first shade member supported between the first and second horizontal bars and a second shade member supported between the first and second vertical legs;

j. whereby the attachment member is attached to the side of a chair by clamping either the parallel walls of the outer arcuate member or the parallel walls of the inner arcuate member around the side of a chair and fastening them against the side of a chair by adjusting the clamshell tightening means, and one of the two vertical legs of the portable and collapsible sunshade apparatus is affixed within the cylindrical leg receiving member and tightened to any desired height above the chair by the adjustment means, and the angle of the shade members to the chair is adjusted by rotating the second body member relative to the first body member by the ratchet mechanism and tightening the two together at the desired amount by the adjustment and tightening means.

26. The combination of an attachment member for attaching the leg of an awning to the side of a chair and a portable and collapsible sunshade apparatus, comprising:

a. an openable clamshell bracket member having a first half rotatably attached to a second half, the two halves having at least one pair of mating parallel walls which are clamped around the side of a chair, the clamshell bracket member further having means to tighten the two halves against each other and to enable the halves to be opened;

b. a first body member extending from one half of the clamshell bracket member and having a wall with a multiplicity of teeth on one surface;

c. a second body member having a wall with a multiplicity of teeth on one surface which mate with the teeth on the first body member to form a ratchet mechanism, and means to adjust and tighten the teeth against each other;

d. the second body further comprising a cylinder with a hollow interior into which a leg of an sunshade apparatus is inserted, and an adjustment means by which the inserted leg can be fastened within the cylinder at any desired location along the length of the leg;

e. a first horizontal bar and a second parallel horizontal bar, the bars maintained in their parallel orientation by a first spreading bar attached adjacent parallel locations of the horizontal bars and a second spreading bar attached adjacent parallel locations on the horizontal bars and at locations spaced apart from the attachment of the first spreading bar;

f. the first spreading bar rotatably attached to the horizontal bars and having means on the interior of the spreading bars by which the spreading bar is rotated to a fixed position to cause the horizontal bar to be spread apart and by which the spreading bar is rotated so the two horizontal bars are adjacent each other;

g. the second spreading bar rotatably attached to the horizontal bars and having means on the interior of the spreading bar by which the spreading bar is rotated to a fixed position to cause the horizontal bars to be spread apart and by which the spreading bar is rotated so the two horizontal bars are adjacent each other;

h. a first support bracket attached at one end of the first horizontal bar and a parallel second support bracket attached at one end of the second horizontal bar, a first vertical leg rotatably attached to the first support bracket, the bracket including means to cause the first vertical leg to extend perpendicular to the first horizontal bar and a second vertical leg rotatably attached to the second support bracket, the bracket including means to cause the second vertical leg to extend perpendicular to the second horizontal bar and parallel to the first vertical leg; and i. a shade member supported between the first and second horizontal bars;

j. whereby the attachment member is attached to the side of a chair by clamping the at least one pair of mating parallel walls around the side of a chair and fastening them against the side of a chair by adjusting the clamshell tightening means, and one of the two vertical legs of the portable and collapsible sunshade apparatus is affixed within the cylindrical leg receiving member and tightened to any desired height above the chair by the adjustment means, and the angle of the shade member to the chair is adjusted by rotating the second body member relative to the first body member by the ratchet mechanism and tightening the two together at the desired amount by the adjustment and tightening means.

* * * * *